US011274898B2

(12) United States Patent
Shaffer et al.

(10) Patent No.: US 11,274,898 B2
(45) Date of Patent: Mar. 15, 2022

(54) CROSSBOW

(71) Applicant: Hunter's Manufacturing Company, Inc., Suffield, OH (US)

(72) Inventors: Michael Shaffer, Mogadore, OH (US); Steve Bednar, Copley, OH (US); Richard Bednar, Munroe Falls, OH (US); Phil Bednar, Copley, OH (US); Jacob Hout, Akron, OH (US); Gary Smith, East Canton, OH (US); Robert Seymour, Jr., Ravenna, OH (US); Keith Bartels, Akron, OH (US)

(73) Assignee: Hunter's Manufacturing Company, Inc., Suffield, OH (US)

( * ) Notice: Subject to any disclaimer, the term of this patent is extended or adjusted under 35 U.S.C. 154(b) by 0 days.

(21) Appl. No.: 17/121,865

(22) Filed: Dec. 15, 2020

(65) Prior Publication Data

US 2021/0102775 A1 Apr. 8, 2021

Related U.S. Application Data

(63) Continuation of application No. 16/700,566, filed on Dec. 2, 2019, now Pat. No. 10,900,739, which is a continuation of application No. 16/130,081, filed on Sep. 13, 2018, now Pat. No. 10,495,404.

(60) Provisional application No. 62/559,886, filed on Sep. 18, 2017.

(51) Int. Cl.
*F41B 5/12* (2006.01)
*F41B 5/14* (2006.01)

(52) U.S. Cl.
CPC ..... *F41B 5/123* (2013.01); *F41B 5/1469* (2013.01)

(58) Field of Classification Search
CPC ..... F41B 5/12; F41B 5/123; F41B 5/1469
USPC ..... 124/25
See application file for complete search history.

(56) References Cited

U.S. PATENT DOCUMENTS

| | | | |
|---|---|---|---|
| 2,092,361 | A | 9/1937 | Shirn |
| 3,043,287 | A | 7/1962 | Nelson |
| 3,561,419 | A | 2/1971 | Cucuzza, Sr. |
| 3,670,711 | A | 6/1972 | Firestone |
| 3,739,765 | A | 6/1973 | Moore |
| 4,192,281 | A | 3/1980 | King |
| 4,246,883 | A | 1/1981 | Ash |
| 4,593,675 | A | 6/1986 | Waiser |
| 4,603,676 | A | 8/1986 | Luoma |
| 4,649,892 | A | 3/1987 | Bozek |
| 4,662,345 | A | 5/1987 | Stephens |
| 4,665,885 | A | 5/1987 | Glomski et al. |

(Continued)

OTHER PUBLICATIONS

European Crossbows, a survey by Josef Alm; copyrighted by the Trustees of the Royal Armouries and the Arms and Armour Society, 1994.

(Continued)

*Primary Examiner* — Alexander R Niconovich
(74) *Attorney, Agent, or Firm* — Emerson Thomson Bennett, LLC

(57) ABSTRACT

A crossbow may include two bowstring guides engaged on first and second sides of the crossbow barrel. The bowstring guides may push the bowstring toward opposite sides of the barrel when the bowstring is moved from the fully uncocked position to the fully cocked position and when the bowstring is moved from the fully cocked position to the fully uncocked position.

20 Claims, 12 Drawing Sheets

(56) References Cited

U.S. PATENT DOCUMENTS

| | | | | |
|---|---|---|---|---|
| 4,719,897 | A | 1/1988 | Gaudreau | |
| 4,721,092 | A | 1/1988 | Waiser | |
| 4,942,861 | A | 7/1990 | Bozek | |
| 5,115,795 | A | 5/1992 | Farris | |
| 5,205,267 | A | 4/1993 | Burdick | |
| 5,215,069 | A | 6/1993 | Liu | |
| 5,220,906 | A | 6/1993 | Choma | |
| 5,243,956 | A | 9/1993 | Luehring | |
| 5,433,186 | A | 7/1995 | Corwin | |
| 5,437,260 | A | 8/1995 | King | |
| 5,445,139 | A | 8/1995 | Bybee | |
| 5,553,596 | A | 9/1996 | Bednar | |
| 5,598,829 | A | 2/1997 | Bednar | |
| 5,649,520 | A | 7/1997 | Bednar | |
| 5,678,528 | A | 10/1997 | Hadley | |
| 5,987,724 | A | 11/1999 | Kleman | |
| 6,095,128 | A | 8/2000 | Bednar | |
| 6,286,496 | B1 | 9/2001 | Bednar | |
| 6,874,491 | B2 | 4/2005 | Bednar | |
| 6,913,007 | B2 | 7/2005 | Bednar | |
| 7,100,590 | B2 | 9/2006 | Chang | |
| 7,578,289 | B2 * | 8/2009 | Norkus | F41B 5/0094 124/25 |
| 7,624,725 | B1 | 12/2009 | Choma | |
| 7,784,453 | B1 | 8/2010 | Yehle | |
| 7,891,348 | B2 | 2/2011 | Colley | |
| 8,387,604 | B1 * | 3/2013 | Terzo | F41B 5/123 124/25.6 |
| 8,443,790 | B2 | 5/2013 | Pestrue | |
| 8,499,753 | B2 | 8/2013 | Bednar | |
| 8,578,918 | B1 * | 11/2013 | Islas | F41B 5/123 124/25 |
| 9,297,604 | B1 * | 3/2016 | Sidebottom | F41B 5/12 |
| 9,377,267 | B1 | 6/2016 | Kempf | |
| 9,494,379 | B2 * | 11/2016 | Yehle | F41B 5/066 |
| 9,513,080 | B1 * | 12/2016 | Kempf | F41B 5/1411 |
| 9,879,938 | B1 | 1/2018 | Isenhower | |
| 10,018,442 | B1 | 7/2018 | Kempf | |
| 10,018,443 | B2 | 7/2018 | Dziekan | |
| 10,139,191 | B1 | 11/2018 | Kempf | |
| 10,184,749 | B2 * | 1/2019 | Trpkovski | F41B 5/105 |
| 10,267,592 | B2 | 4/2019 | Bartels | |
| 10,473,418 | B2 * | 11/2019 | Shaffer | F41B 5/123 |
| 10,962,323 | B2 * | 3/2021 | Langley | F41B 5/1411 |
| 2006/0086346 | A1 | 4/2006 | Middleton | |
| 2009/0101126 | A1 * | 4/2009 | Anderson | F41B 5/1469 124/25 |
| 2010/0170488 | A1 | 7/2010 | Rasor | |
| 2011/0056467 | A1 * | 3/2011 | Popov | F41B 5/1469 124/25.6 |
| 2013/0213373 | A1 * | 8/2013 | Biafore, Jr. | F41B 5/1403 124/25 |

OTHER PUBLICATIONS

The Book of the Crossbow, by Ralph Payne-Gallwey, published by Dover Publications, Inc. of New York, 1995; 400 pgs.

A Guide to the Crossbow, by W.F. Paterson, published by the Society of Archer-Antiquaries, 1990; 134 Pgs.

* cited by examiner

CROSSBOW

CROSS-REFERENCE TO RELATED APPLICATIONS

This application is a continuation of U.S. patent application Ser. No. 16/700,566, filed Jun. 4, 2020 which is a continuation of U.S. patent application Ser. No. 16/130,081, filed Sep. 13, 2018, which claims the benefit of U.S. Provisional Application No. 62557886, filed Sep. 13, 2017, the entirety of which is fully incorporated by reference herein.

BACKGROUND

The present subject matter is directed to apparatuses and methods regarding crossbows. More specifically the present subject matter is directed to apparatuses and methods for guidance of the bowstring of a crossbow.

Crossbows have been used for many years as a weapon for hunting and fishing, and for target shooting. Crossbows typically comprise a bowstring engaged through set of pulleys to a set of limbs and to a set of power cords. Engagement of the bowstring is of interest. It is of interest to make the engagement of the bowstring reliable, light, inexpensive, low maintenance, safe, and adjustable.

It remains desirable to improve the apparatuses and methods by which the engagement of the bowstring may be modified to suit the designer or user or both.

SUMMARY

According to some embodiments of this invention, a crossbow may comprise: an elongated barrel having a first barrel side and a second barrel side opposite the first barrel side; a bow engaged with the elongated barrel; a first limb set supported to the first barrel side; a second limb set supported to the second barrel side; an elongated bowstring: 1) having a first end operatively engaged with the first limb set; 2) having a second end operatively engaged with the second limb set; and 3) movable between a fully cocked position and a fully uncocked position; a first bowstring guide: 1) engaged with the first barrel side; 2) adapted to push the bowstring toward the second barrel side when the bowstring is moved from the fully uncocked position to the fully cocked position; and 3) adapted to push the bowstring toward the second barrel side when the bowstring is moved from the fully cocked position to the fully uncocked position; and a second bowstring guide: 1) engaged with the second barrel side; 2) adapted to push the bowstring toward the first barrel side when the bowstring is moved from the fully uncocked position to the fully cocked position; and 3) adapted to push the bowstring toward the first barrel side when the bowstring is moved from the fully cocked position to the fully uncocked position.

According to some embodiments of this invention, a crossbow method may comprise the steps of: A) providing a crossbow including: 1) an elongated barrel having a first barrel side and a second barrel side opposite the first barrel side; 2) a bow engaged with the elongated barrel; 3) a first limb set supported to the first barrel side; 4) a second limb set supported to the second barrel side; 5) an elongated bowstring: a) having a first end operatively engaged with the first limb set; b) having a second end operatively engaged with the second limb set; and c) movable between a fully cocked position and a fully uncocked position; 6) a first bowstring guide engaged with the first barrel side; and 7) a second bowstring guide engaged with the second barrel side; B) providing the first bowstring guide to be operable when the bowstring is moved from the fully uncocked position to the fully cocked position to push the bowstring toward the second barrel side; C) providing the first bowstring guide to be operable when the bowstring is moved from the fully cocked position to the fully uncocked position to push the bowstring toward the second barrel side; D) providing the second bowstring guide to be operable when the bowstring is moved from the fully uncocked position to the fully cocked position to push the bowstring toward the first barrel side; and E) providing the second bowstring guide to be operable when the bowstring is moved from the fully cocked position to the fully uncocked position to push the bowstring toward the first barrel side.

According to some embodiments of this invention, a crossbow may comprise: an elongated barrel having a first barrel side and a second barrel side opposite the first barrel side; a bow engaged with the elongated barrel; a first limb set supported to the first barrel side; a second limb set supported to the second barrel side; an elongated bowstring: 1) having a first end operatively engaged with the first limb set; 2) having a second end operatively engaged with the second limb set; and 3) movable between a fully cocked position and a fully uncocked position; a first bowstring guide: 1) engaged with the first barrel side; 2) having a barrel facing surface; and 3) adapted to push the bowstring toward the second barrel side when the bowstring is moved between the fully uncocked position and the fully cocked position; a second bowstring guide: 1) engaged with the second barrel side; 2) having a barrel facing surface; and 3) adapted to push the bowstring toward the first barrel side when the bowstring is moved between the fully uncocked position and the fully cocked position; wherein: 1) the barrel facing surface of the first bowstring guide is a distance D1 from the barrel when the bowstring is moved from the fully uncocked position to the fully cocked position; 2) the barrel facing surface of the first bowstring guide is a distance D2 from the barrel when the bowstring is moved from the fully cocked position to the fully uncocked position; 3) D1=D2; 4) the barrel facing surface of the second bowstring guide is a distance D3 from the barrel when the bowstring is moved from the fully uncocked position to the fully cocked position; 5) the barrel facing surface of the second bowstring guide is a distance D4 from the barrel when the bowstring is moved from the fully cocked position to the fully uncocked position; and 6) D3=D4.

BRIEF DESCRIPTION OF THE DRAWINGS

The present subject matter may take physical form in certain parts and arrangement of parts, embodiments of which will be described in detail in this specification and illustrated in the accompanying drawings which form a part hereof and wherein.

DEFINITIONS

Figure 1:
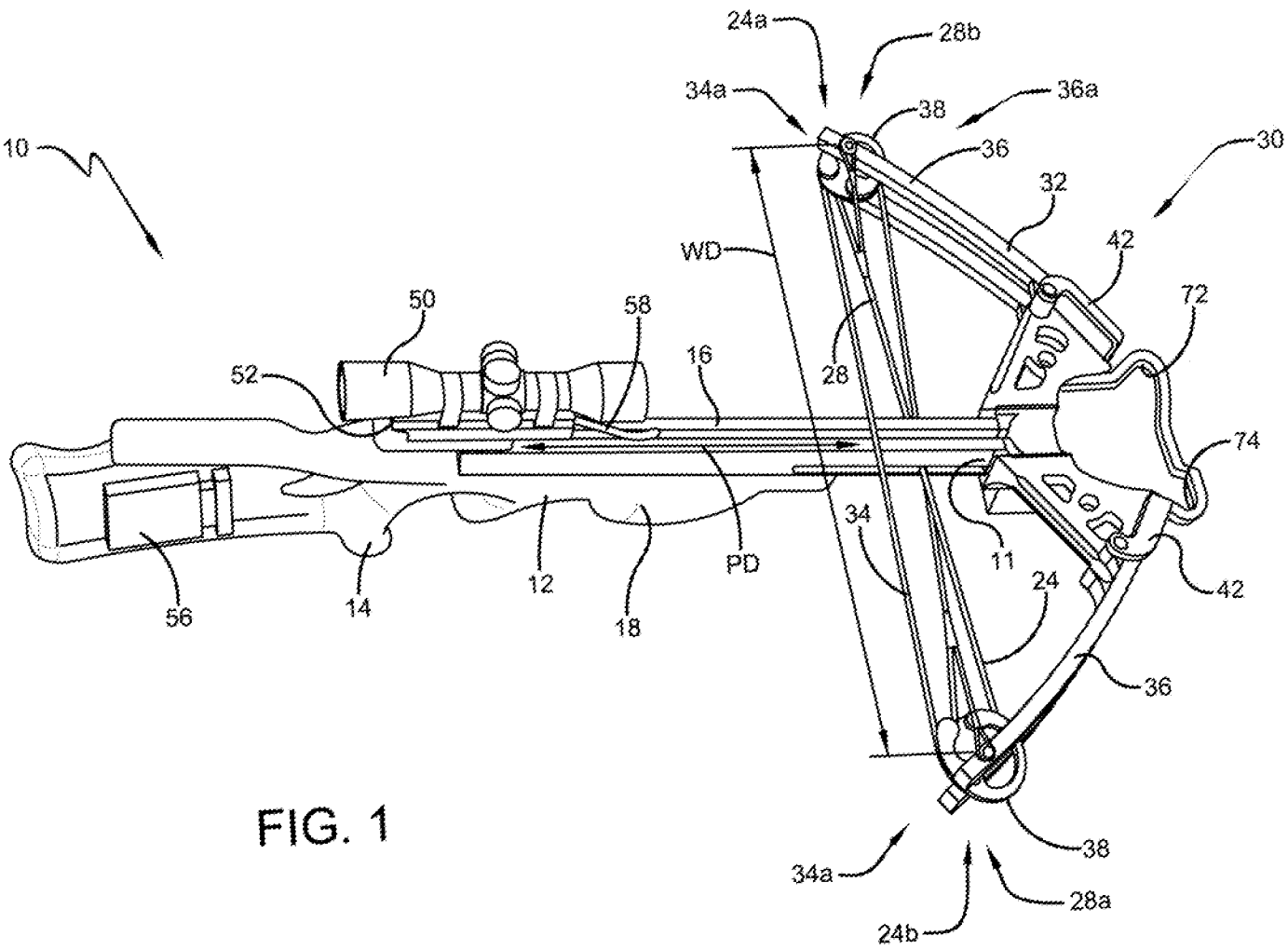
FIG. 1 is a view of one non-limiting embodiment of a conventional crossbow.

The following definitions are controlling for the disclosed subject matter:

"Arrow" means a projectile that is shot with (or launched by) a bow assembly.

"Bow" means a bent, curved, or arched object.

"Bow Assembly" means a weapon comprising a bow and a bowstring that shoots or propels arrows powered by the elasticity of the bow and the drawn bowstring.

"Bowstring" means a string or cable attached to a bow.

"Compound Bow" means a crossbow that has wheels, pulleys or cams at each end of the bow through which the bowstring passes.

"Crossbow" means a weapon comprising a bow assembly and a trigger mechanism both mounted to a main beam.

"Draw Weight" means the amount of force required to draw or pull the bowstring on a crossbow into a cocked condition.

"Main Beam" means the longitudinal structural member of a weapon used to support the trigger mechanism and often other components as well. For crossbows, the main beam also supports the bow assembly. The main beam often comprises a stock member, held by the person using the weapon, and a barrel, used to guide the projectile being shot or fired by the weapon.

"Power Stroke" means the linear distance that the bowstring is moved between the uncocked condition and the cocked condition.

"Trigger Mechanism" means the portion of a weapon that shoots, fires or releases the projectile of a weapon. As applied to crossbows, trigger mechanism means any device that holds the bowstring of a crossbow in the drawn or cocked condition and which can thereafter be operated to release the bowstring out of the drawn condition to shoot an arrow.

"Weapon" means any device that can be used in fighting or hunting that shoots or fires a projectile including bow assemblies and crossbows.

DETAILED DESCRIPTION

Referring now to the drawings wherein the showings are for purposes of illustrating embodiments of the present subject matter only and not for purposes of limiting the same, and wherein like reference numerals are understood to refer to like components, provided are a crossbow, crossbow components, and a method of using a crossbow and crossbow components.

FIG. 1 shows a crossbow 10. While the crossbow 10 shown uses a compound bow, it should be understood that this invention will work well with any type of crossbow chosen with sound judgment by a person of ordinary skill in the art.

The crossbow 10 has a main beam 12 which may include a stock member 14, and a barrel 16. The main beam 12 may be made by assembling the stock member 14 and the barrel 16 together as separate components or, in another embodiment, the main beam 12 may be made as one piece. A handgrip 18 may be mounted to the main beam 12 in any conventional manner chosen with sound judgment by a person of ordinary skill in the art. A trigger mechanism 20 suitable for shooting an arrow is mounted to the main beam 12 in any suitable manner. It should be noted that the crossbow 10 may comprise any trigger mechanism chosen with sound judgment by a person of ordinary skill in the art. The crossbow 10 also includes a bow assembly 30 adapted to propel an associated arrow and having a bow 32 and a bowstring 34. The bow 32 may include a set of limbs 36, 36 that receive the bowstring 34 in any conventional manner chosen with sound judgment by a person of ordinary skill in the art. For the embodiment shown, a pair of wheels, pulleys, or cams 38, 38 mounted to the limbs 36, 36 receive the bowstring 34 in an operational manner. In each of the non-limiting embodiments, the set of limbs has a first side **36*a* and a second side 36*b* opposite the first side 36*a* with first side 36*a* being operationally engaged with a first cam 38 and second side 36*b* being operationally engaged with a second cam 38. The bow may also include a riser 40. The riser 40 may comprise a set of limb pockets 42, 42 adapted to receive the limbs 36, 36, as shown in FIG. 1**.

Without limitations, other crossbow components may be optionally used with a crossbow as provided herein. Without limitation, in some non-limiting embodiments, a crossbow 10 shown may include a scope 50 attached to a scope mount 52 that is supported on the main beam 12. Other optional components shown include a cocking unit 56, and arrow holder 58. In certain non-limiting embodiments, the riser 40 may have an opening 72 formed therein defining a foot stirrup 74 adapted for holding and balancing the crossbow by foot.

A crossbow 10 may have a power stroke distance PD. The distance between the pivot axes of the wheels, pulleys, or cams 38, 38 may be some distance WD.

A crossbow may comprise a bow assembly mounted with the bowstring cams rearward of the riser, or mounted with the bowstring cams forward of the riser. A crossbow with the bow assembly mounted with the bowstring cams rearward of the riser is sometimes referred to as a conventional crossbow, while a crossbow with the bow assembly mounted with the bowstring cams forward of the riser is sometimes referred to as a reversed crossbow. The subject matter herein applies to both conventional crossbows and reversed crossbows.

Figure 2:
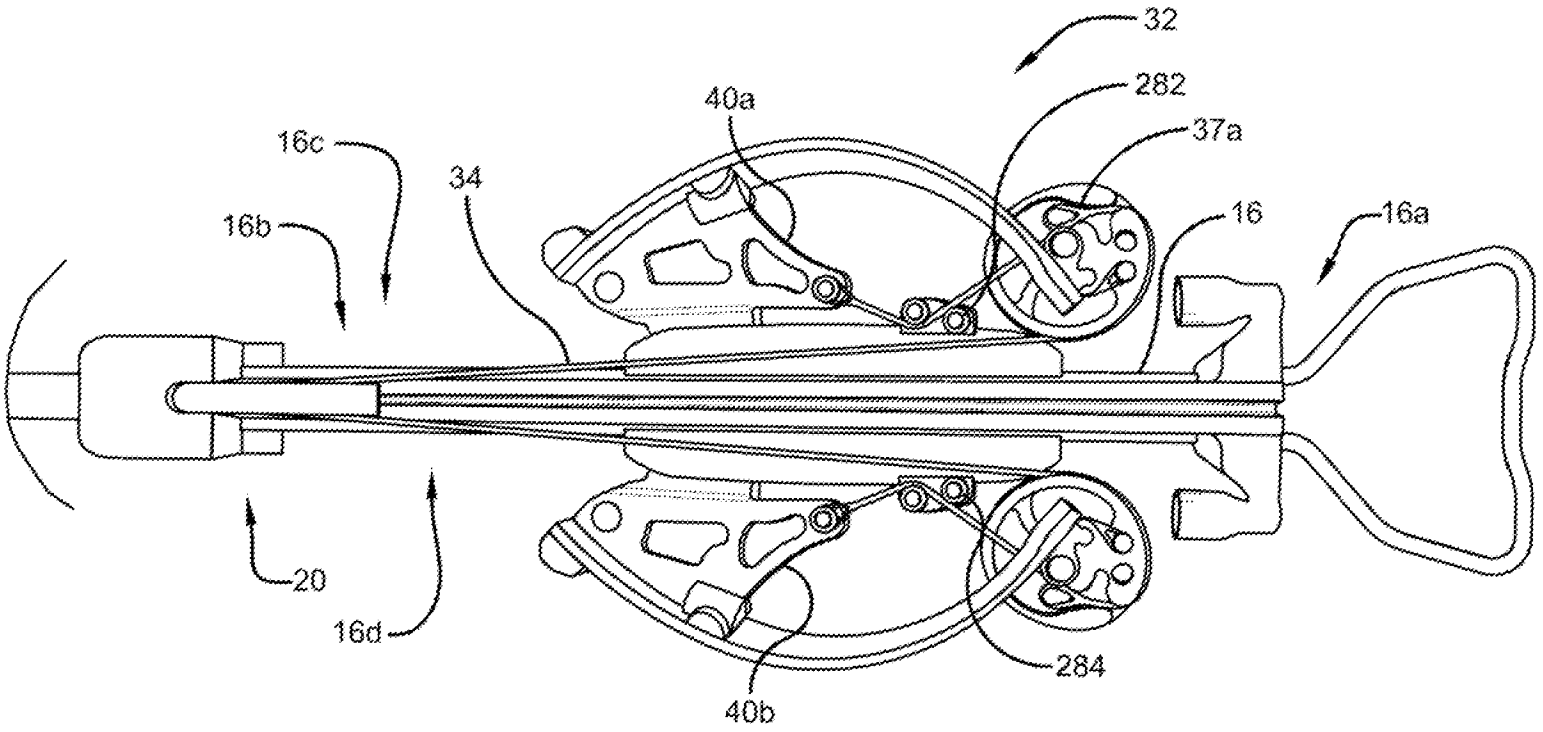
FIG. 2 is another view of one non-limiting embodiment of a reverse draw crossbow.

With reference to the crossbow shown in FIG. 2, in some non-limiting embodiments a crossbow may comprise an elongated barrel 16; a trigger 20; a bow 32; an elongated bowstring 34; a first bowstring guide 282; and a second bowstring guide 284.

With continued reference to the crossbow shown in FIG. 2, an elongated barrel 16 may have a front barrel end **16*a* and a rear barrel end 16*b* opposite the front barrel end 16*a*, and a first barrel side 16*c* and a second barrel side 16*d* opposite the first barrel side 16*c***.

With continued reference to the crossbow shown in FIG. 2, a trigger 20 may be operationally engaged with barrel 16 to selectably retain and selectably release a bowstring at the discretion of an operating user.

With continued reference to the crossbow shown in FIG. 2, a bow 32 may be engaged with the elongated barrel where the bow 32 has a riser 40, a first limb set **36*a*, a second limb set 36***b*, a first cam 38, and a second cam 38. A riser 40 may have a first riser side 40*a* and a second riser side 40*b* opposite the first riser side 40*a*. The first riser side 40*a* may be engaged with the first barrel side 16*c* in such a manner as to be substantially fixed in position and orientation with respect to the first barrel side 16*c*. The second riser side 40*a* may be engaged with the first barrel side 16*c* in such a manner as to be substantially fixed in position and orientation with respect to the first barrel side 16*c*. The actual physical connection engaging the barrel 16 and the riser 40 may take a number of forms: the riser may be engaged with barrel 16 at the barrel sides 16*a*, 16*b*, front, bottom or some combination thereof. A riser 40 may serve as a framework for offsetting the limb sets from the barrel 16 and supporting loaded limb sets. A first limb set 36 may be engaged to the first riser side 40*a*. The first limb set 36 may be elongated to define a hysteretic spring having a first end engaged with the riser and a second end opposite the first end and free to deflect with respect to the riser 40. The first limb set 36 may define a first limb axis 37*a*. A second limb set 36 may be engaged to the second riser side 40*b*. The second limb set 36 may be elongated to define a hysteretic spring having a first end engaged with the riser and a second end opposite the first end and free to deflect with respect to the riser 40. The second limb set 36 may define a second limb axis 37*b*. Without limitation, the second limb axis 37*b* may be parallel to the first limb axis 37*b*.

With continued reference to the crossbow shown in FIG. 2, a first cam 38 may have a first cam axis 422, a first cam plane 432 normal to the first cam axis 422, a first cam plate 434, a first top power cord channel 452, and a first bottom power cord channel 462. The first cam plane 432 may be normal to the first cam axis 422. The first cam plate 434 may have a first top surface 436, a first bottom surface 437 opposite the first top surface 436, and a first perimeter surface 438. A first perimeter surface 438 may extend between the first top surface 436 and the first bottom surface 437, the first perimeter surface 438 defining a first concave bowstring channel 439 extending around the first cam axis 422 along a first plane curve 412 within the first cam plane 432. The first plane curve 412 may vary in distance from the first cam axis 422 or may be a constant radial distance from the first cam axis 422. In those embodiments in which the first plane curve is a constant radius distance from the first cam axis 422, the cam is round wheel, or section of a round wheel, with the first cam axis 422 coincident with the wheel center. In those embodiments in which the first plane curve 412 varies in distance from the first cam axis 422, the cam 38 is a variable radius cam. The first top power cord channel 452 may extend from the first top surface 436 along a first top helical path 454 having a first top helix axis 456 coincident with the first cam axis 422. The first top helical path 454 may be a cylindrical helix or a spiral helix. The first bottom power cord channel 462 may extend from the first bottom surface 437 along a first bottom helical path 464 having a first bottom helix axis 466 coincident with the first cam axis 422. The first bottom helical path 464 may be a cylindrical helix or a spiral helix. In some non-limiting embodiments, the first bottom power cord channel 462 is a mirror image of the first top power cord channel 452.

With continued reference to the crossbow shown in FIG. 2, a second cam 38 may have a second cam axis 422, a second cam plane 432 normal to the second cam axis 422, a second cam plate 434, a second top power cord channel 452, and a second bottom power cord channel 462. The second cam plane 432 may be normal to the second cam axis 422. The second cam plate 434 may have a second top surface 436, a second bottom surface 437 opposite the second top surface 436, and a second perimeter surface 438. A second perimeter surface 438 may extend between the second top surface 436 and the second bottom surface 437, the second perimeter surface 438 defining a second concave bowstring channel 439 extending around the second cam axis 422 along a second plane curve 412 within the second cam plane 432. The second plane curve 412 may vary in distance from the second cam axis 422 or may be a constant radial distance from the second cam axis 422. In those embodiments in which the second plane curve is a constant radius distance from the second cam axis 422, the cam is round wheel, or section of a round wheel, with the second cam axis 422 coincident with the wheel center. In those embodiments, in which the second plane curve 412 varies in distance from the second cam axis 422, the cam 38 is a variable radius cam. The second top power cord channel 452 may extend from the second top surface 436 along a second top helical path 454 having a second top helix axis 456 coincident with the second cam axis 422. The second top helical path 454 may be a cylindrical helix or a spiral helix. The second bottom power cord channel 462 may extend from the second bottom surface 437 along a second bottom helical path 464 having a second bottom helix axis 466 coincident with the second cam axis 422. The second bottom helical path 464 may be a cylindrical helix or a spiral helix. In some non-limiting embodiments the second bottom power cord channel 462 is a mirror image of the second top power cord channel 452.

With continued reference to the crossbow shown in FIG. 2, an elongated bowstring may have a first end 34*a* and a second end 34*b* opposite the first end 34*a*. In some embodiments, the first end 34*a* may be operatively engaged with the first cam 38. In some embodiments, the second end 34*b* may be operatively engaged with the second cam 38. The bowstring may be movable between a cocked position and an uncocked position as detailed herebelow.

With continued reference to the crossbow shown in FIG. 2, a first bowstring guide 282 may be engaged with the first barrel side 16*c*. The first bowstring guide 282 may be adapted to push the bowstring 34 toward the second barrel side 16*d* during at least part of an operation during which the bowstring 34 is moved between a cocked position and an uncocked position.

With continued reference to the crossbow shown in FIG. 2, a second bowstring guide 282 may be engaged with the second barrel side 16*d*. The second bowstring guide 282 may be adapted to push the bowstring 34 toward the first barrel side 16*c* during at least part of an operation during which the bowstring 34 is moved between a cocked position and an uncocked position.

An operation during which the bowstring 34 is moved between a cocked position and an uncocked position may refer to either: a cocking operation, or a decocking operation. During a cocking operation, the bowstring 34 is moved from an uncocked position to a cocked position. FIGS. 3, 4, 5, and 6, in that order, show the progress of a cocking operation as a user moves a bowstring from an uncocked position toward the cocked position shown in FIG. 7. During a decocking operation, the bowstring 34 is moved from a cocked position to an uncocked position. FIGS. 8, 9, 10, and 11, in that order, show the progress of a decocking operation as a user moves a bowstring from the cocked position shown in FIG. 7 to an uncocked position.

Figure 3:
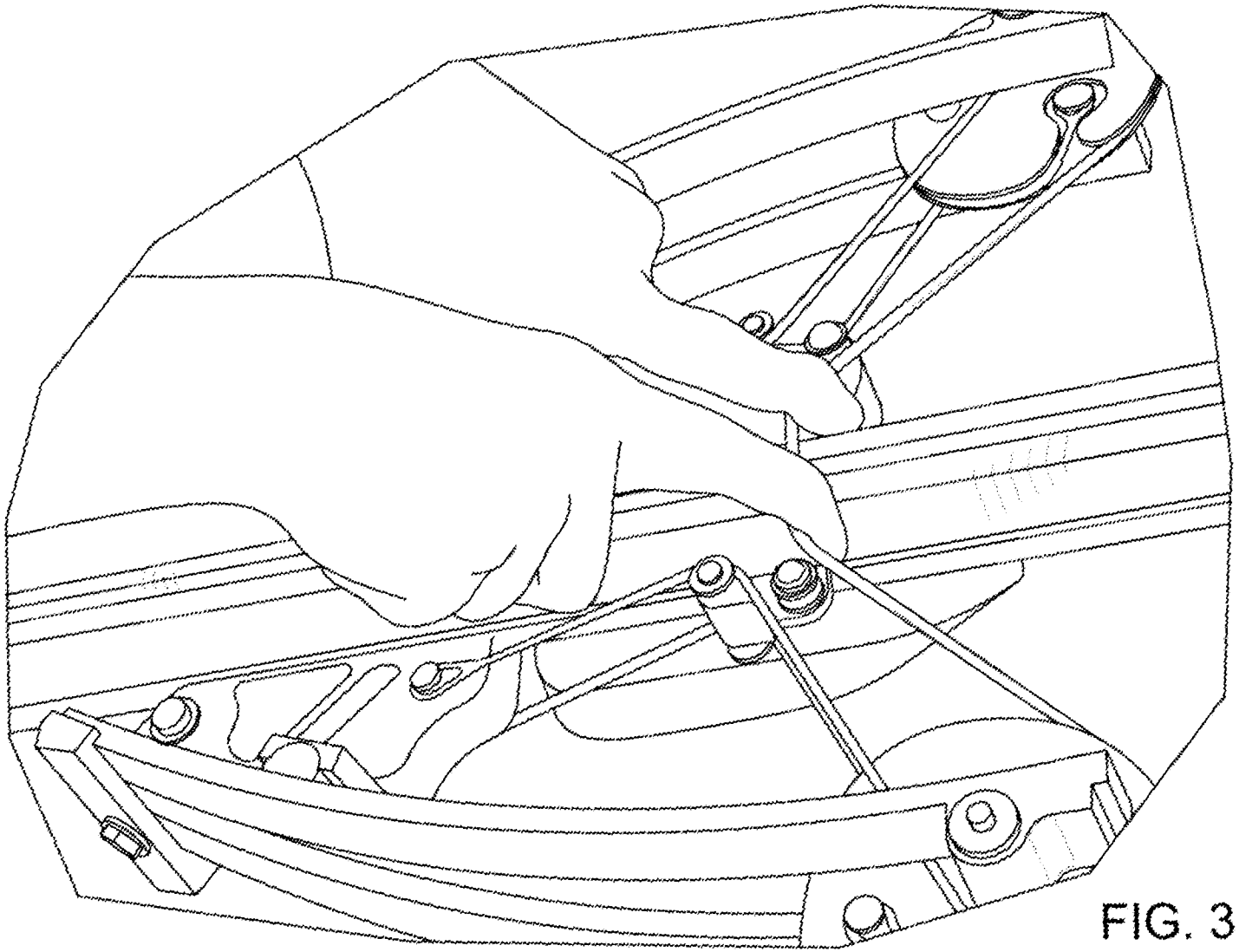
FIG. 3 is another view of one non-limiting embodiment of a reverse draw crossbow.
Figure 4:
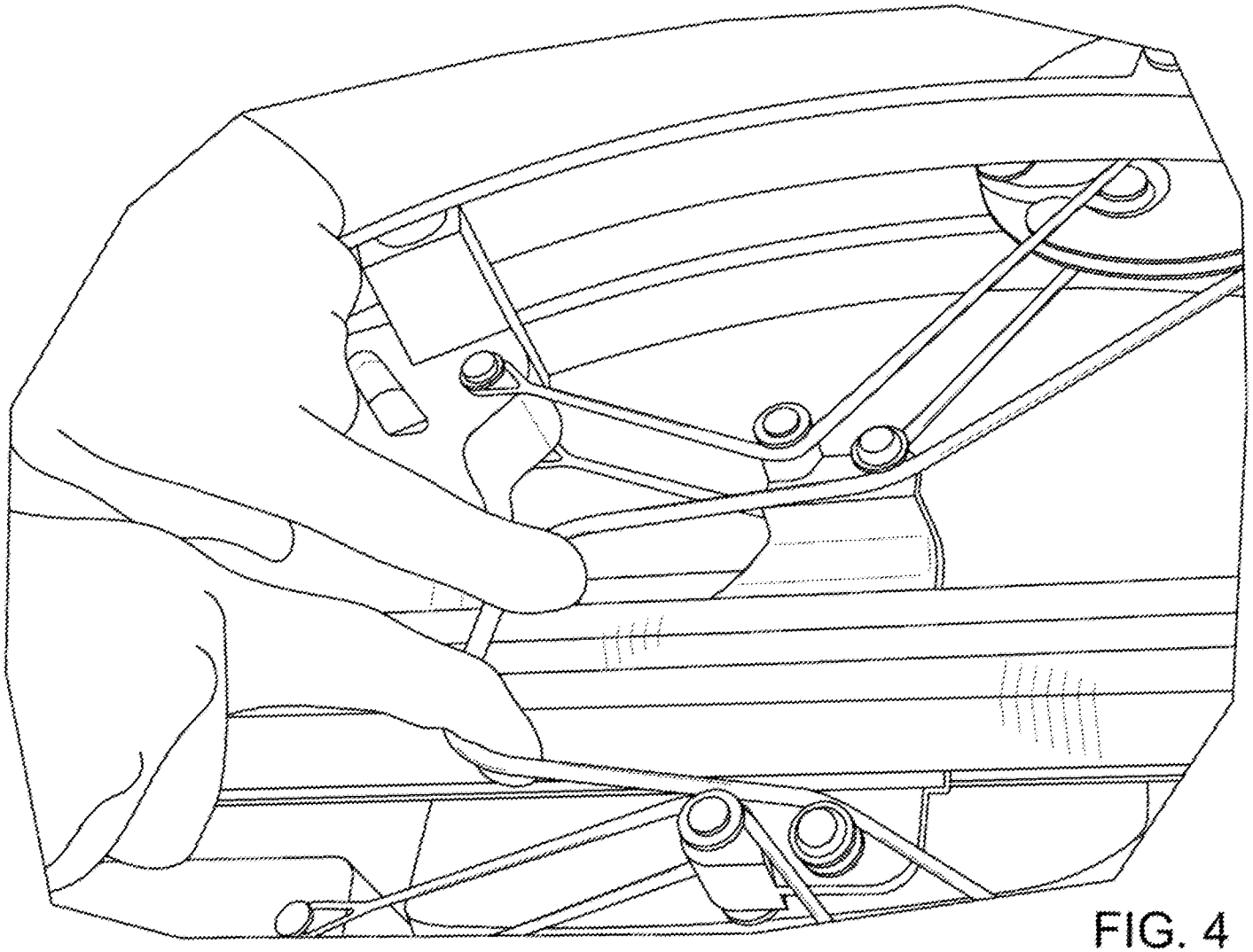
FIG. 4 is another view of one non-limiting embodiment of a reverse draw crossbow.
Figure 5:
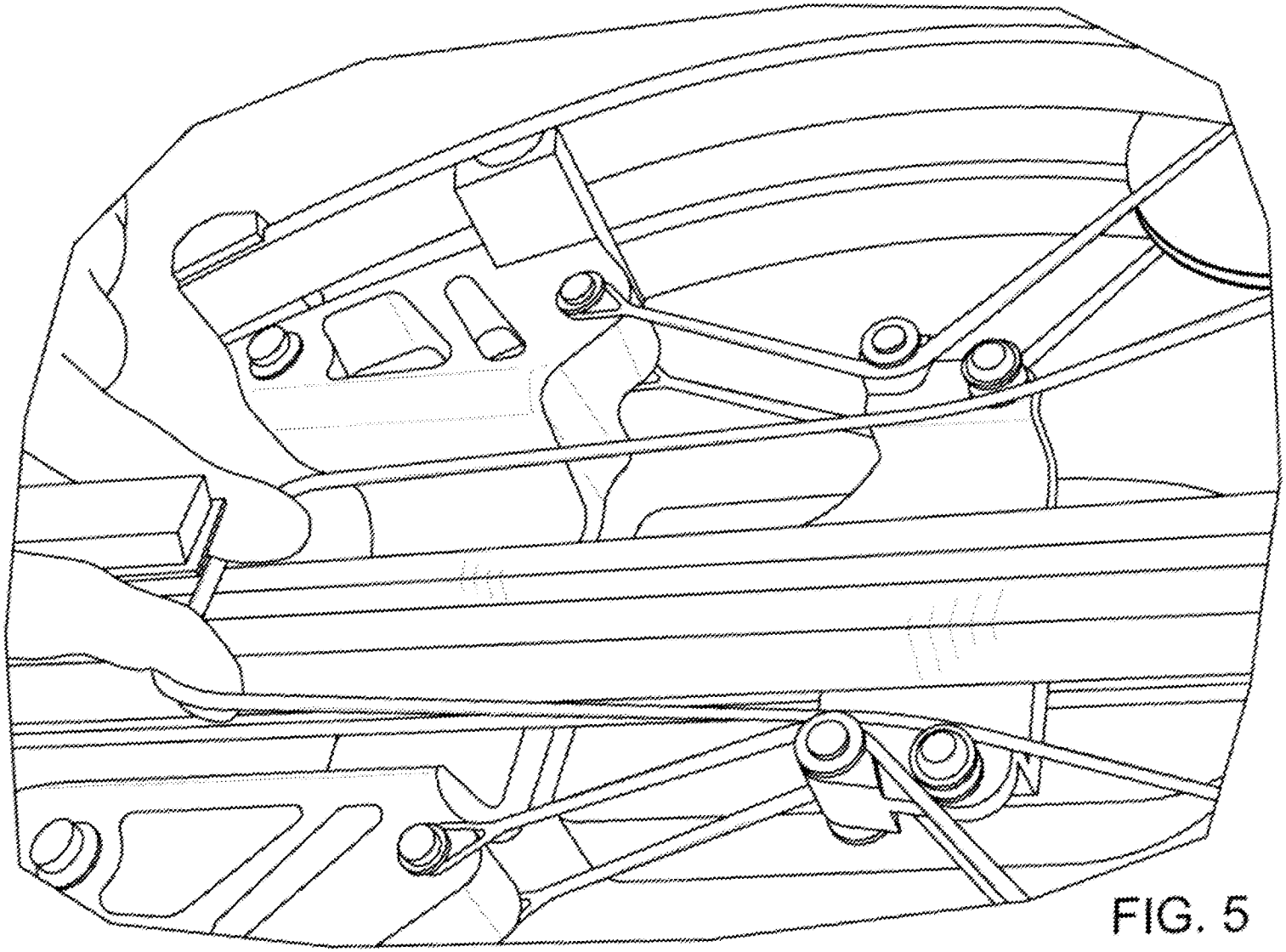
FIG. 5 is another view of one non-limiting embodiment of a reverse draw crossbow.

In some embodiments, a crossbow may comprise one or more bowstring guides 282, 284. The bowstring guide 282, 284, may be a pin, wheel, pulley, or other surface adapted to guide the path of a bowstring during a cocking operation or a decocking operation. In the non-limiting embodiment shown in FIGS. 2-11, there is a first bowstring guide 282 on a first barrel side 16*c* and a second bowstring guide 284 on a second barrel side 16*d*. The bowstring in the uncocked position extends between two offset cams 38. As shown in FIG. 3, as the bowstring is gradually cocked, it is pulled back and forms a broad generally V-shaped form. As shown in FIG. 4, as the bowstring is further cocked, it is pulled back and comes into contact with the bowstring guides 282, 284 which change the from the cocked bowstring 34 from a simple V-shape to one which is narrows at the guides to more closely conform to the barrel 16. In these embodiments the bowstring guides 282, 284 help to prevent the bowstring from striking, interfering with, or contacting components with which an unguided bowstring would strike, interfere, or contact. In FIGS. 2-11, the power cord and guide elements for the power cords are separated from the path of the bowstring by the bowstring guides 282, 284.

Figure 6:
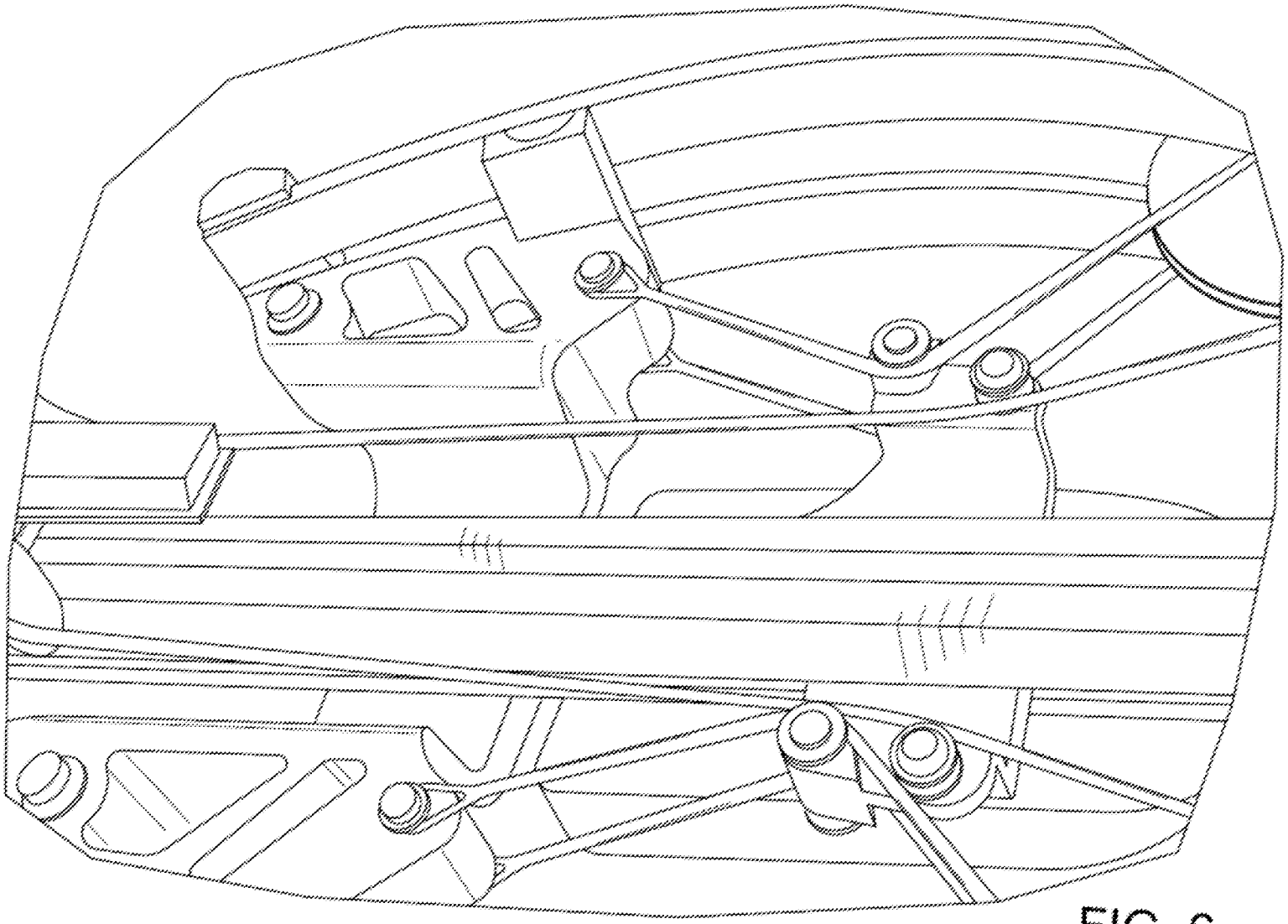
FIG. 6 is another view of one non-limiting embodiment of a reverse draw crossbow.
Figure 7:
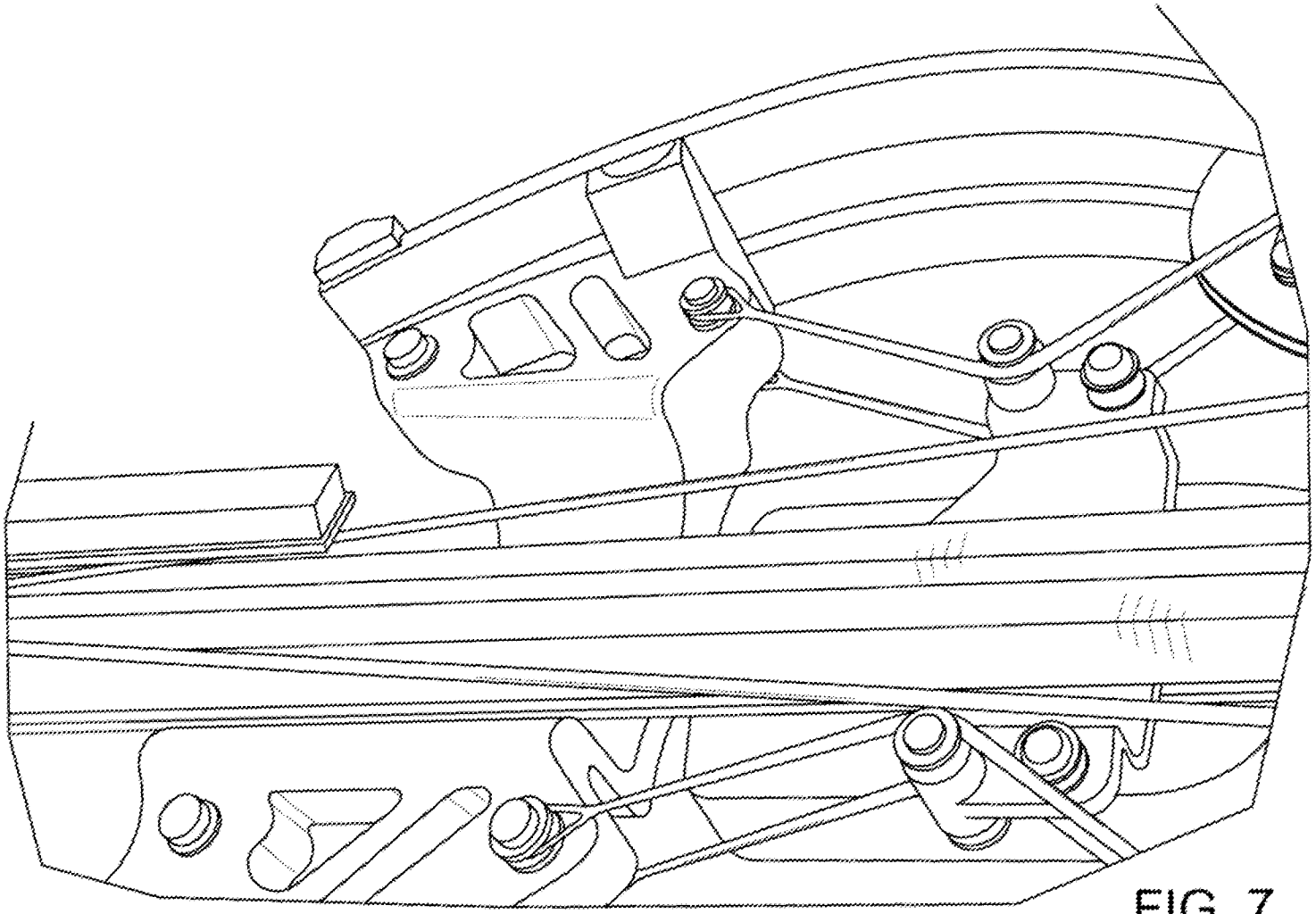
FIG. 7 is another view of one non-limiting embodiment of a reverse draw crossbow.
Figure 8:
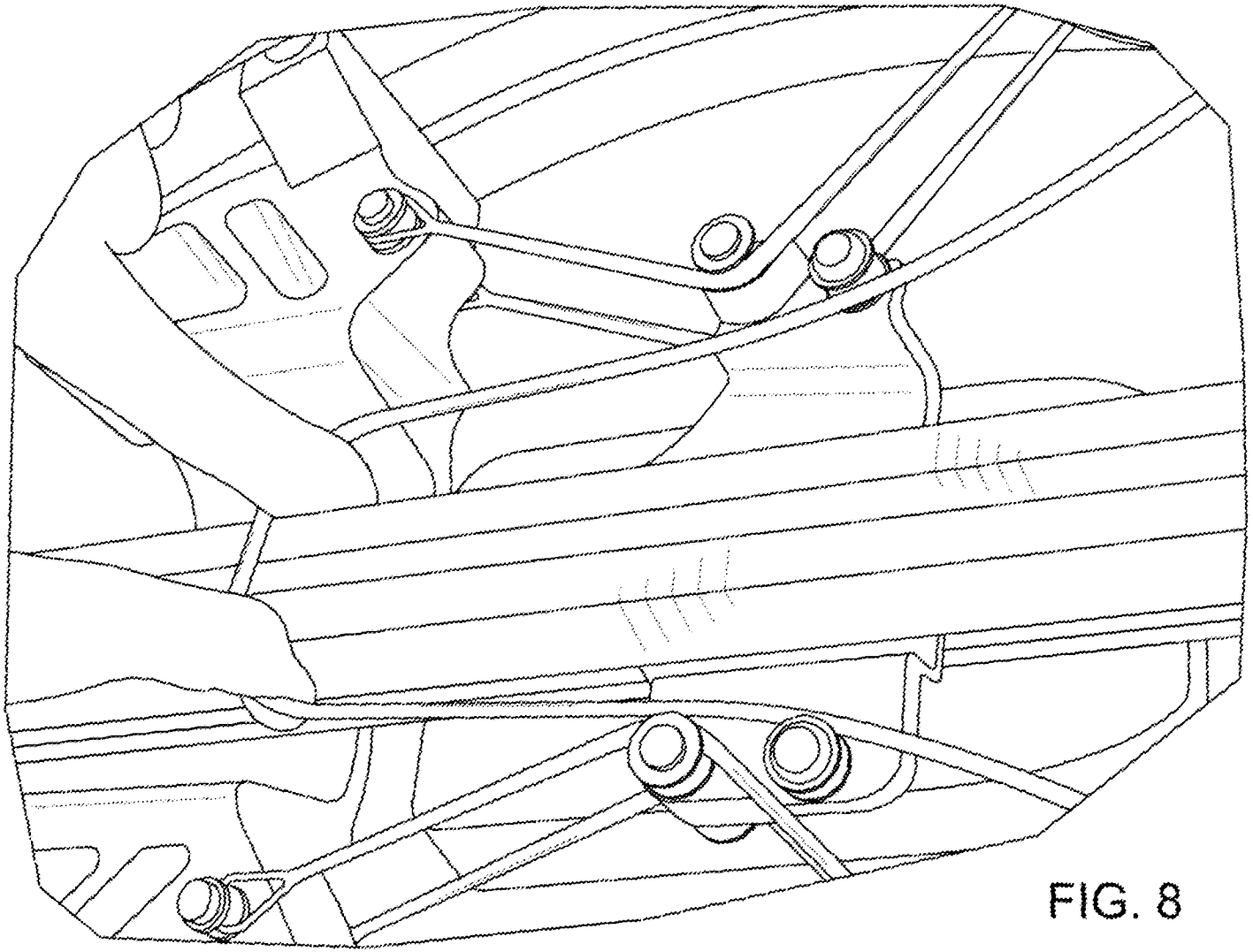
FIG. 8 is another view of one non-limiting embodiment of a reverse draw crossbow.
Figure 9:
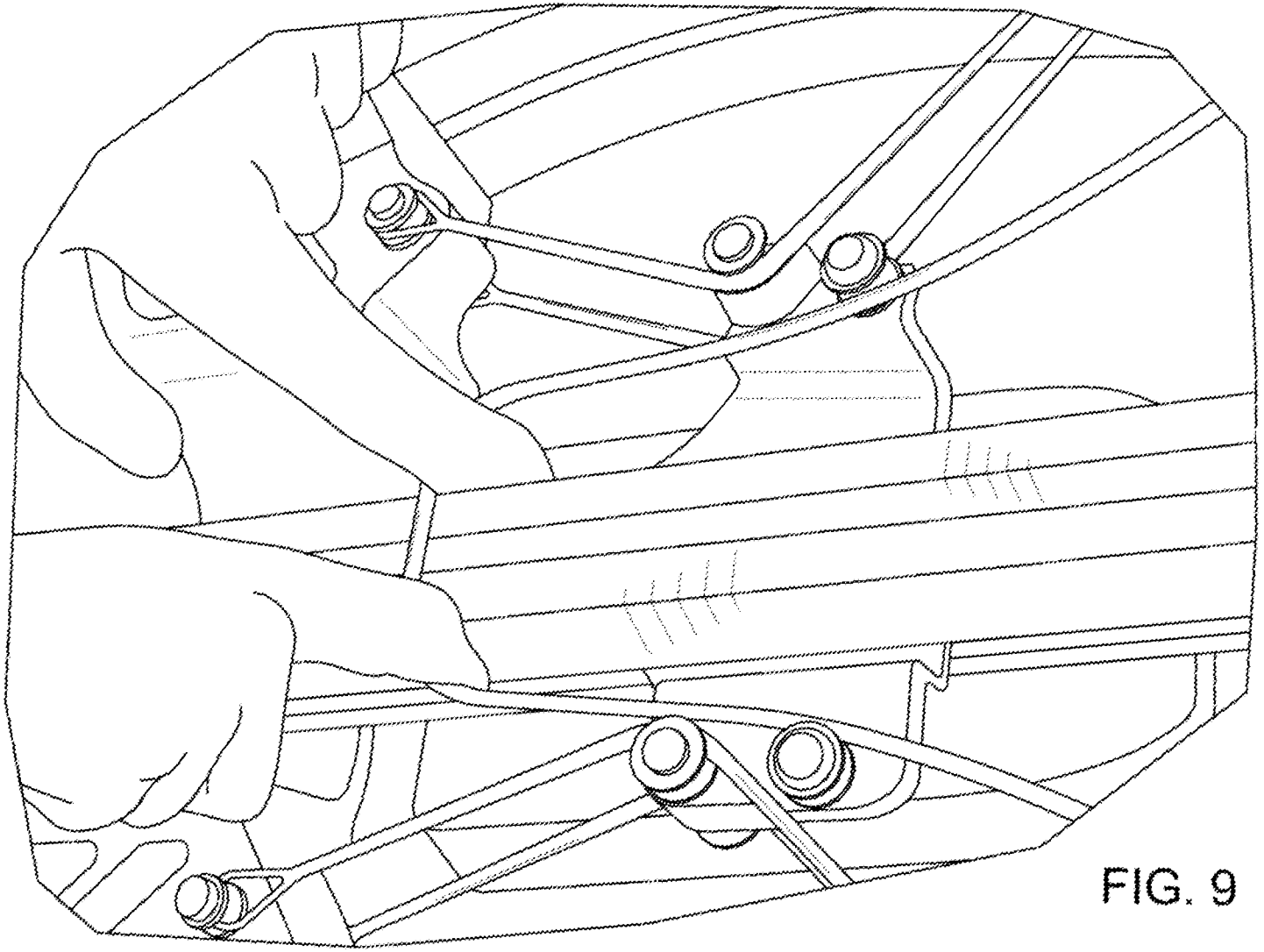
FIG. 9 is another view of one non-limiting embodiment of a reverse draw crossbow.
Figure 10:
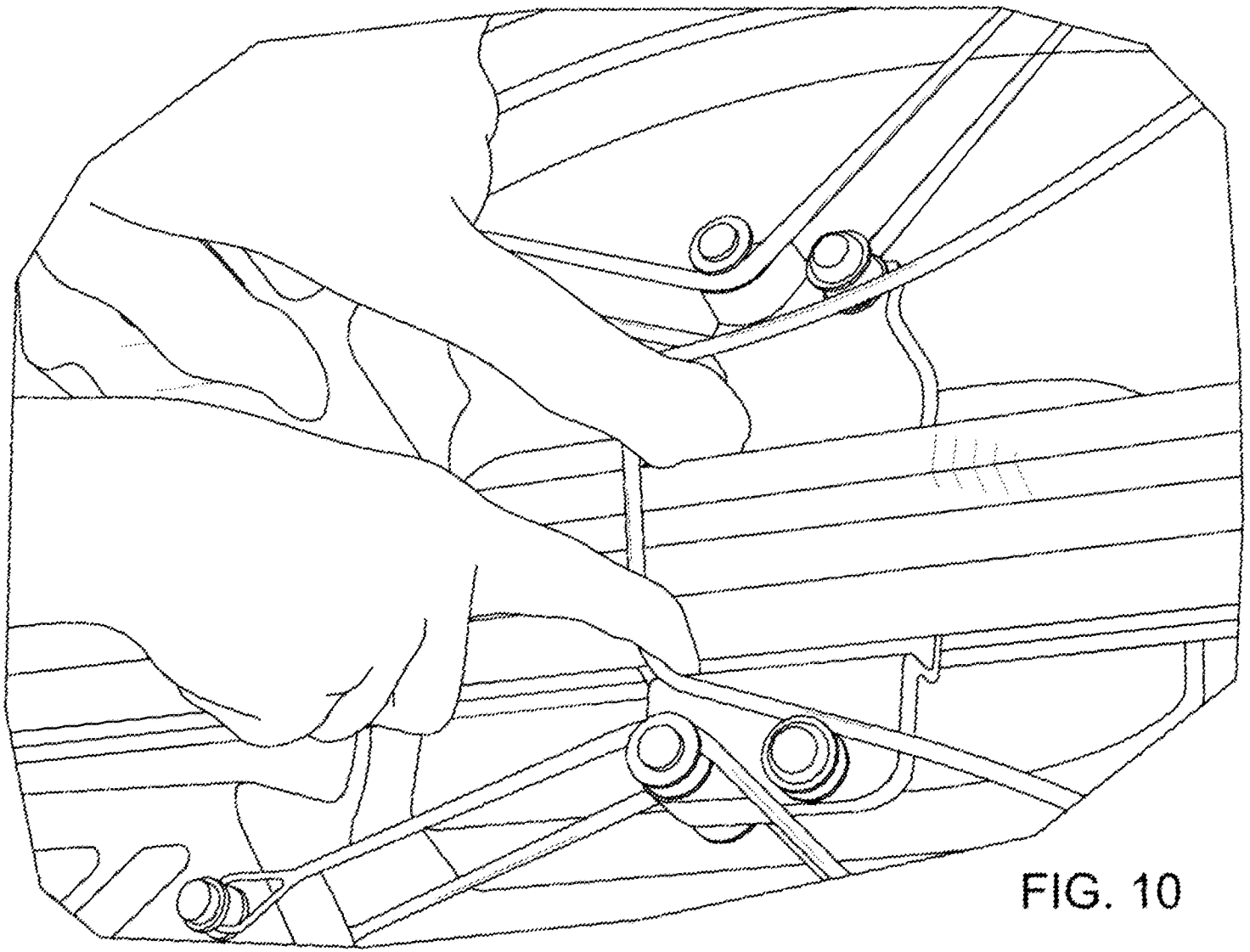
FIG. 10 is another view of one non-limiting embodiment of a reverse draw crossbow.
Figure 11:
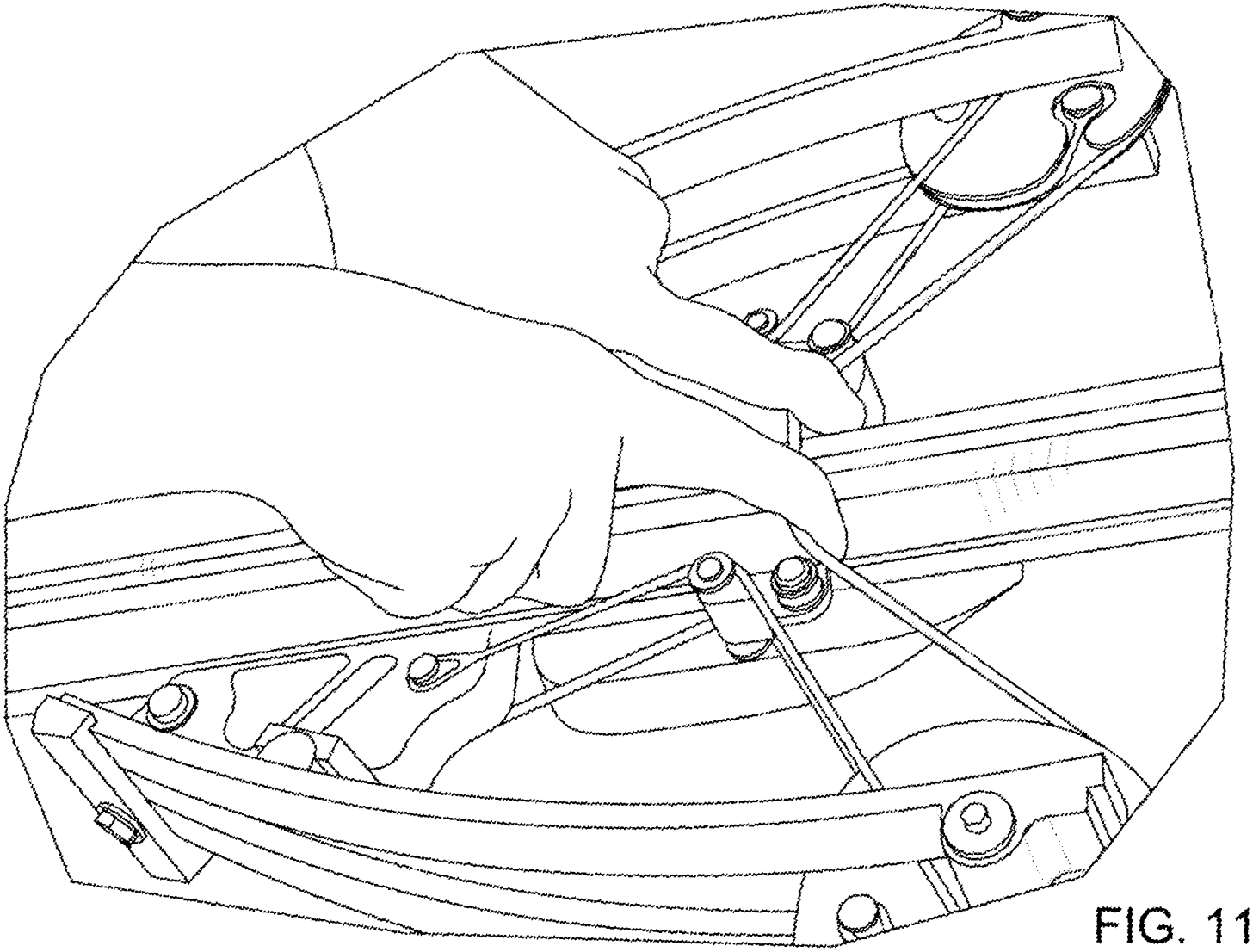
FIG. 11 is another view of one non-limiting embodiment of a reverse draw crossbow.
Figure 12:
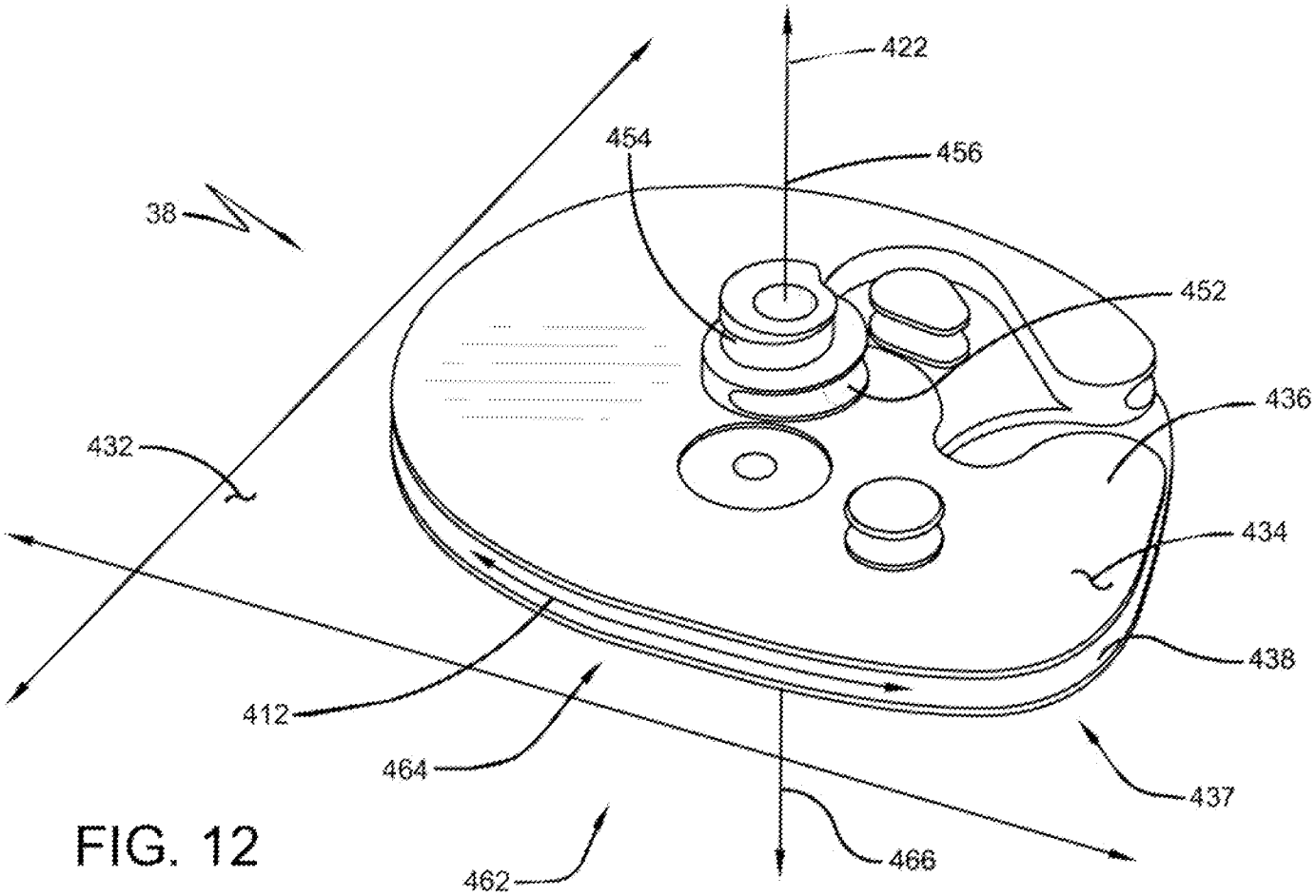
FIG. 12 is view of one non-limiting embodiment of a cam.

It should be noted that in some embodiments, the bowstring guides 282, 284 may only contact the bowstring 34 during a portion of the cocking operation or decocking operation. As shown in FIG. 3 the bowstring 34 has not yet contacted the guides 282, 284. As shown in FIG. 4 the bowstring 34 is in contact with the guides 282, 284. As shown in FIG. 6 the bowstring 34 is in no longer contact with the guides 282, 284: the cams have pulled together sufficiently that the top of the V-shaped form defined by the bowstring is narrow enough that the bowstring 34 is in no longer contact with the guides 282, 284. As shown in FIG. 7 the bowstring 34 is in no longer contact with the guides 282, 284. In the images showing the decocking of the bowstring 34, FIGS. 8-11 it can be seen that the bowstring 34 contacts the guides as it moves to uncocked position but then again moves out of contact therewith. It should be understood that a firing operation is a form of decocking operation.

In the non-limiting embodiments shown the bowstring guides are pulleys and each defining an operational plane, the operational planes of the guides are coincident with one another and are coincident with the first cam plane and the second cam plane.

Numerous embodiments have been described, hereinabove. It will be apparent to those skilled in the art that the above methods and apparatuses may incorporate changes and modifications without departing from the general scope of the present subject matter. It is intended to include all such modifications and alterations in so far as they come within the scope of the appended claims or the equivalents thereof.

Having thus described the invention, it is now claimed:

1. A crossbow comprising:

an elongated barrel having a first barrel side and a second barrel side opposite the first barrel side;

a bow engaged with the elongated barrel;

a first limb set supported to the first barrel side;

a second limb set supported to the second barrel side;

an elongated bowstring:

1) having a first end operatively engaged with the first limb set;

2) having a second end operatively engaged with the second limb set; and 3) movable between a fully cocked position and a fully uncocked position;

a first bowstring guide:

1) engaged with the first barrel side;

2) adapted to push the bowstring toward the second barrel side at the same time as the bowstring is moved from the fully uncocked position to the fully cocked position; and 3) adapted to push the bowstring toward the second barrel side at the same time as the bowstring is moved from the fully cocked position to the fully uncocked position; and a second bowstring guide:

1) engaged with the second barrel side;

2) adapted to push the bowstring toward the first barrel side at the same time as the bowstring is moved from the fully uncocked position to the fully cocked position; and 3) adapted to push the bowstring toward the first barrel side at the same time as the bowstring is moved from the fully cocked position to the fully uncocked position; and, wherein:

1) the first bowstring guide is a pulley or cam rotatable about a first bowstring guide axis;

2) the second bowstring guide is a pulley or cam rotatable about a second bowstring guide axis; and 3) when the bowstring is in the fully cocked position:

a) the first bowstring guide does not contact the bowstring; and b) the second bowstring guide does not contact the bowstring.

2. The crossbow of claim 1 wherein:

the first bowstring guide axis is parallel to the second bowstring guide axis.

3. The crossbow of claim 1 further comprising a trigger:

engaged with the elongated barrel; and operable to permit the bowstring to move from the fully cocked position to the fully uncocked position.

4. The crossbow of claim 1 wherein:

the crossbow is a conventional crossbow.

5. The crossbow of claim 1 wherein:

the crossbow is a reversed crossbow.

6. The crossbow of claim 1 wherein:

when the bowstring is in the fully uncocked position:

the first bowstring guide does not contact the bowstring; and the second bowstring guide does not contact the bowstring.

7. The crossbow of claim 1 wherein:

a first cam:

1) is supported to the first limb set; and 2) has a bowstring channel;

a second cam:

1) is supported to the second limb set; and 2) has a bowstring channel;

the first end of the bowstring is received within the bowstring channel of the first cam; and the second end of the bowstring is received within the bowstring channel of the second cam.

8. The crossbow of claim 1 wherein:

a first power cord distinct from the bowstring is positioned on the first barrel side; and a second power cord distinct from the first power cord and the bowstring is positioned on the second barrel side.

9. The crossbow of claim 8 wherein:

a first power cord guide is:

1) engaged with the first barrel side; and 2) adapted to contact the first power cord; and a second power cord guide is:

1) engaged with the second barrel side; and 2) adapted to contact the second power cord.

10. The crossbow of claim 9 wherein:

a portion of the first power cord is positioned between the first power cord guide and the first bowstring guide; and a portion of the second power cord is positioned between the second power cord guide and the second bowstring guide.

11. The crossbow of claim 1 wherein:

the first bowstring guide has a barrel facing surface;

the second bowstring guide has a barrel facing surface;

the barrel facing surface of the first bowstring guide is a distance D1 from the barrel at the same time as the bowstring is moved from the fully uncocked position to the fully cocked position;

the barrel facing surface of the first bowstring guide is a distance D2 from the barrel at the same time as the bowstring is moved from the fully cocked position to the fully uncocked position;

$$D1=D2;$$

the barrel facing surface of the second bowstring guide is a distance D3 from the barrel at the same time as the bowstring is moved from the fully uncocked position to the fully cocked position;

the barrel facing surface of the second bowstring guide is a distance D4 from the barrel at the same time as the bowstring is moved from the fully cocked position to the fully uncocked position; and $$D3=D4.$$

12. The crossbow of claim 11 wherein:

$$D1=D3.$$

13. A crossbow method comprising the steps of:

A) providing a crossbow including:

1) an elongated barrel having a first barrel side and a second barrel side opposite the first barrel side;

2) a bow engaged with the elongated barrel;

3) a first limb set supported to the first barrel side;

4) a second limb set supported to the second barrel side;

5) an elongated bowstring:

a) having a first end operatively engaged with the first limb set;

b) having a second end operatively engaged with the second limb set; and c) movable between a fully cocked position and a fully uncocked position;

6) a first bowstring guide that is:

a) a pulley or cam rotatable about a first bowstring guide axis; and b) engaged with the first barrel side; and 7) a second bowstring guide that is:

a) a pulley or cam rotatable about a second bowstring guide axis; and b) engaged with the second barrel side;

B) providing the first bowstring guide to be operable at the same time as the bowstring is moved from the fully uncocked position to the fully cocked position to push the bowstring toward the second barrel side;

C) providing the first bowstring guide to be operable at the same time as the bowstring is moved from the fully cocked position to the fully uncocked position to push the bowstring toward the second barrel side;

D) providing the second bowstring guide to be operable at the same time as the bowstring is moved from the fully uncocked position to the fully cocked position to push the bowstring toward the first barrel side;

E) providing the second bowstring guide to be operable at the same time as the bowstring is moved from the fully cocked position to the fully uncocked position to push the bowstring toward the first barrel side; and F) providing that when the bowstring is in the fully cocked position:

1) the first bowstring guide does not contact the bowstring; and 2) the second bowstring guide does not contact the bowstring.

14. The crossbow method of claim 13 wherein:

step A includes the step of: providing the first bowstring guide axis to be parallel to the second bowstring guide axis.

15. The crossbow method of claim 13 wherein:

step A includes the step of: providing a trigger engaged with the elongated barrel; and the method also includes the step of: providing the trigger to be operable to permit the bowstring to move from the fully cocked position to the fully uncocked position.

16. The crossbow method of claim 13 wherein:

the crossbow is a conventional crossbow.

17. The crossbow method of claim 13 wherein:

the crossbow is a reversed crossbow.

18. The crossbow method of claim 13 further comprising the step of:

providing that when the bowstring is in the fully uncocked position:

1) the first bowstring guide does not contact the bowstring; and 2) the second bowstring guide does not contact the bowstring.

19. The crossbow method of claim 13 further comprising the steps of:

providing a first cam that:

1) is supported to the first limb set; and 2) has a bowstring channel;

providing a second cam that:

1) is supported to the second limb set; and 2) has a bowstring channel;

providing the first end of the bowstring to be received within the bowstring channel of the first cam; and providing the second end of the bowstring to be received within the bowstring channel of the second cam.

20. The crossbow method of claim 13 further comprising the steps of:

providing a first power cord distinct from the bowstring is positioned on the first barrel side;

providing a second power cord distinct from the first power cord and the bowstring is positioned on the second barrel side, providing a first power cord guide that is:

1) engaged with the first barrel side; and 2) adapted to contact the first power cord; and Providing a second power cord guide that is:

1) engaged with the second barrel side; and 2) adapted to contact the second power cord.

* * * * *